US006325563B1

(12) United States Patent
Matechuk

(10) Patent No.: US 6,325,563 B1
(45) Date of Patent: Dec. 4, 2001

(54) MANUALLY OPERABLE SPREADING APPARATUS FOR FLOWABLE MATERIALS

(76) Inventor: William Matechuk, 6270 Doreen Dr., Niagara Falls, Ontario (CA), L2E 5K2

( * ) Notice: Subject to any disclaimer, the term of this patent is extended or adjusted under 35 U.S.C. 154(b) by 0 days.

(21) Appl. No.: 09/562,111

(22) Filed: May 1, 2000

(51) Int. Cl.[7] ..... A46B 11/00

(52) U.S. Cl. ..... 401/140; 401/261; 401/138; 401/48; 15/228; 15/244

(58) Field of Search ..... 401/140, 138, 401/261, 263, 48, 137, 264; 15/228, 244.1

(56) References Cited

U.S. PATENT DOCUMENTS 1,049,797 * 1/1913 Arntt ..... 401/140
1,122,079 * 1/1914 Cunneen ..... 401/140
3,134,129 * 5/1964 Allen ..... 401/140
4,468,830 * 9/1984 Batchelor ..... 15/244.1

* cited by examiner

*Primary Examiner*—David J. Walczak
(74) *Attorney, Agent, or Firm*—McConnell and Fox

(57) ABSTRACT

A manually operable spreading apparatus for uniformly spreading a flowable material, such as a sealant or adhesive, on a surface comprises a rod with a transversely extending replaceable foam spreader pad at one end and a reservoir chamber for the flowable material mounted on the rod. A valve at the reservoir lower end is operable to discharge material from the reservoir for engagement with the spreader pad . The spreader pad is provided with a pair of spring urged side pads pivoted at its ends to form therewith a rectangular structure confining the flowable material to the area over which the spreader moves. A handle is provided part way down the rod to enable the operator to control the pressure of the pad on the surface.

3 Claims, 2 Drawing Sheets

MANUALLY OPERABLE SPREADING APPARATUS FOR FLOWABLE MATERIALS

FIELD OF THE INVENTION

This invention is concerned with improvements in or relating to manually operable spreading apparatus for flowable materials, more specifically with improvements in or relating to apparatus for spreading a flowable adhesive and/or sealing material on a surface, such as a floor, to which flooring material, such as carpet, vinyl tile, and rugs are to be fastened.

BACKGROUND OF THE INVENTION

A number of service industries in which a decorative or protective finish is applied to a surface employ an adhesive and/or sealing material for that purpose and require that a thin coating of the material be spread uniformly on the receiving surface. A particular industry with such a requirement is the installation of coverings on floors and/or walls, such as carpet, sheet plastics material, plastic or ceramic tiles, and layers of thin hardwood strips. The sealants and adhesives are supplied in a variety of containers of the type also generally used for paints. Thus, small quantities of a litre or part liter are supplied in metal cans with press-on lids, while larger quantities, e.g. 20 or 40 liters, are supplied in small plastic drums with snap-on lids. Irrespective of the size of the surface that is to be coated, the usual method of application is for a quantity of the material to be poured onto the surface, if it is sufficiently easily flowable, or if too viscous to be poured easily, for small quantities to be scooped from the container and dumped on the surface. It is then spread uniformly by the operator, kneeling when the surface is a floor, employing for the purpose a metal or plastics hand tool of approximately rectangular shape, usually about 20 cm (8 ins) in width, the longer straight edge which engages the floor being toothed or serrated in a regular pattern so as to provide a row of uniform-size, uniformly-spaced gaps whereby corresponding uniform-size, uniformly parallel spaced lines of the adhesive are formed on the surface as the tool is dragged over it, the surplus material being pressed ahead of the tool and escaping around the edges. Such operations are labour-intensive and also tend to be somewhat messy unless the operator is particularly careful, especially as the container is emptied, when it becomes more difficult to extract the remaining material therefrom. There is therefore a need for apparatus which facilitates delivery of the material to the surface and also facilitates its subsequent spreading over the surface.

SUMMARY OF THE INVENTION

It is therefore the principal object of the invention to provide new manually operable spreading apparatus for flowable materials providing for the ready supply and even application of the flowable material onto the surface on which it is to be spread under the control of the operator.

It is another object to provide in such apparatus a container for the flowable material that facilitates its supply to the surface under the control of the operator and renewal of the supply of the material to the apparatus.

It is a further object to provide such spreading apparatus having a spreader pad that facilitates control of the spread of the flowable material over the receiving surface.

In accordance with the present invention there is provided manually operable spreading apparatus for the uniform spreading on a surface of a flowable material comprising:

a rod for grasping by an operator of the apparatus;

a spreader pad at one end of the rod extending transversely therefrom and having a transversely extending surface engaging portion;

a reservoir chamber for flowable material on the rod intermediate its ends, the resevoir chamber having an upper end and a lower end; and valve means at the lower end of the reservoir chamber operable by the operator to permit discharge of flowable material from the reservoir on to the surface for engagement and spreading thereon by the spreader pad.

Also in accordance with the invention there is provided spreading apparatus for the uniform spreading on a surface of a flowable material comprising:

a rod for grasping by an operator of the apparatus;

a spreader pad mounted in a spreader pad retainer at one end of the rod extending transversely therefrom at a right angle thereto and having a transversely extending surface engaging portion;

a pair of side pads in side pad retainers pivotally mounted at respective ends of the spreader pad, each having a surface engaging portion extending at a respective right angle to the spreader pad surface engaging portion, the side pads forming with the spreader pad a rectangular retaining structure into which flowable material to be spread is discharged and which confines the flowable material to the area of the surface over which the spreader pad is moved by the operator; and spring means operative between each side pad retainer and the spreader pad retainer and urging the respective side pad to rotate in the direction required to maintain contact of its entire surface engaging portion with the surface as the inclination of the rod to the surface is changed.

Also in accordance with the invention there is provided spreading apparatus for the uniform spreading on a surface of a flowable material comprising:

a rod for grasping by the operator of the apparatus;

a spreader pad mounted in a spreader pad retainer at one end of the rod extending transversely therefrom at a right angle thereto and having a transversely extending surface engaging portion;

a pair of side pads in side pad retainers pivotally mounted at respective ends of the spreader pad, each having a surface engaging portion extending at a respective right angle to the spreader pad surface engaging portion, the side pads forming with the spreader pad a rectangular retaining structure into which flowable material to be spread is discharged and which confines the flowable material to the area of the surface over which the spreader pad is moved by the operator; and spring means operative between each side pad retainer and the spreader pad retainer and urging the respective side pads to rotate in the direction required to maintain contact of its entire surface engaging portion with the surface as the inclination of the rod to the surface is changed;

a handle attached to said rod intermediate its ends for grasping by an operator for controlling the pressure applied to said spreader pad.

DESCRIPTION OF THE DRAWINGS

Manually operable spreading apparatus that is the particular preferred embodiment of the invention will now be described, by way of example, with reference to the accompanying diagrammatic drawings, wherein.

DESCRIPTION OF THE PREFERRED EMBODIMENTS

Figures 1, 2:
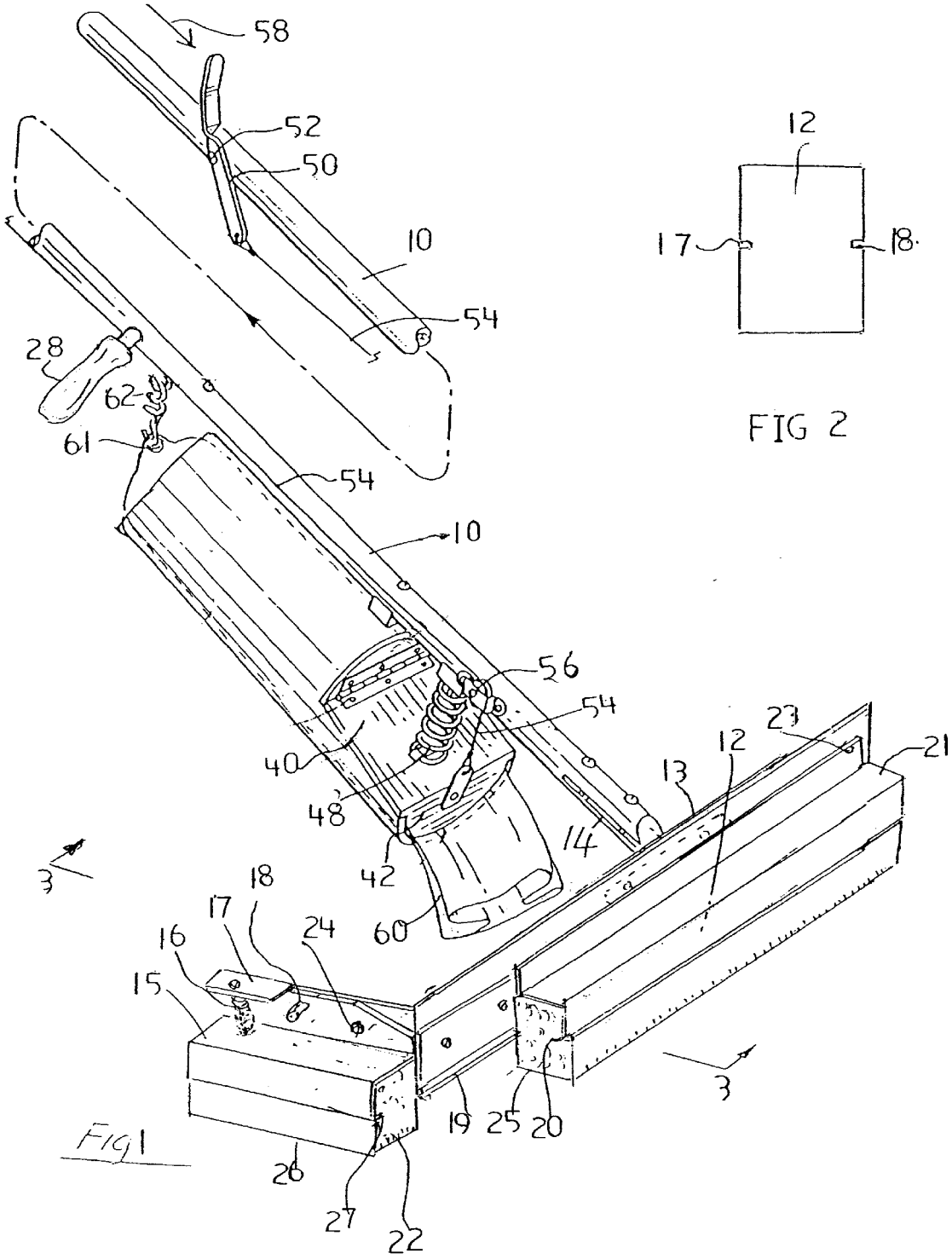
FIG. 1 is a perspective view, partly cut away, from one side of a spreading apparatus according to my invention.
FIG. 2 is an enlarged cross-section of the spreader pad.
Figure 3:
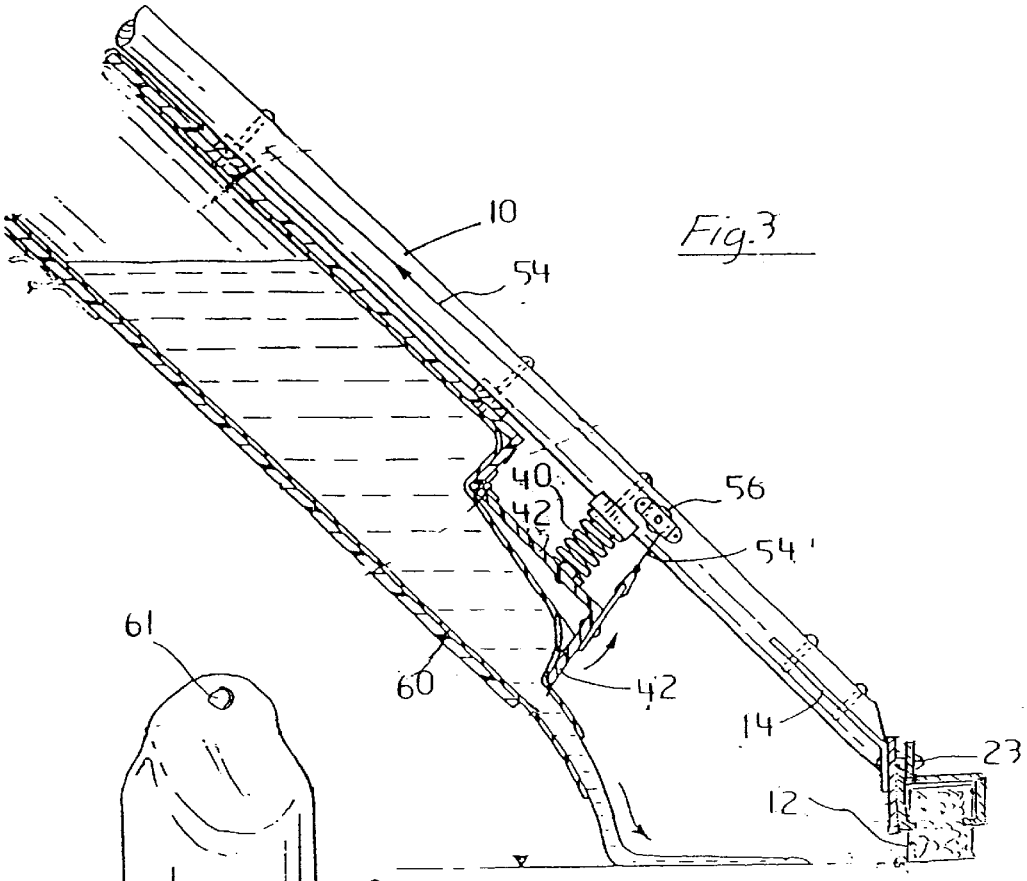
FIG. 3 is a longitudinal cross-section through the apparatus of FIG. 1 taken on the line 3—3 in that Figure.
Figure 5:
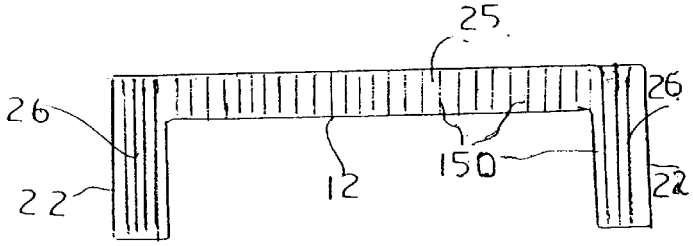
FIG. 5 is a plan view of the spreader pad as viewed from below

The spreading apparatus of FIGS. 1 and 3 comprises an elongated rod 10 of circular cross section and of length, e.g. 137 cms (54 ins), such that the device is easily operable by the operator while standing. The rod carries at its lower end a rectangular transversely extending spreader main pad member 12, which in this embodiment is 46 cm (18 ins) in width, the main pad member being mounted in a retainer 13 fastened to the rod via an attachment bracket 14. The main pad member comprises an elongated foam member of rectangular cross section, as illustrated in FIGS. 2 and 5, that engages the surface over which flowable material is to be spread by the device. For most applications the portion of the pad which engages the surface is serrated in a regular pattern ,as shown in FIG. 5 which illustrates the serrations 150 which provide a row of uniform-size, uniformly-spaced interstices whereby corresponding uniform-size, uniformly spaced lines of the material are left on the surface as the apparatus is moved over it. The pad member is conveniently replaceable so that when it has been used and the foam is saturated with the flowable material it may disposed of and a new pad used for the next job.

The main pad member 12 and the side pads 22 are moulded from a suitable firm foam material such as an open cell foam sold by "Rubatex" under the designation SL 41. Preferably the main pad and the side pads are formed as a one piece moulding.

As will be seen in FIG. 2 the pad is provided with two slots 17 and 18 which extend longitudinally along both sides of the pad. these slots are engaged by lip 19 on retainer 13 and lip 20 on clamp 21. Clamp 21 is mounted on retainer 13 by bolts such as bolt 23. To replace the pad it is only necessary to unbolt the clamp 21 from the retainer 13, slide the side pads 22 out of retainers 15 and remove the pad 12. The new pad may then be installed by slipping the side pads 22 into their retainers 15 until the main pad 12 is tight up against retainer 13 replacing the clamp 21 and the bolts 23.

A problem with the narrower hand held tools used hitherto is that the surplus material ahead of the tool escapes around the edges as it is moved over the surface, making it more difficult and time consuming to ensure that the coating obtained is uniform, since the tool must be moved repeatedly over the escaped material to level it. This problem is avoided with the apparatus of the invention by the provision of the side pads 22 which are integral with the main pad and mounted in retainers 15 which are pivotally mounted by respective pivots 24 at opposite ends of the main spreader pad retainer member 13. The retainers 15 are urged downwards at their trailing edges by springs 16 which bear against a flange 17 on the retainer member 13 and limited in their rotation by stud 18 which travels in an arcuate slot in retainer 15. The side pads are retained in retainers 15 by lips 27 which engage slots on the outer side of the side pads. Each side pad has a respective surface engaging portion 26 extending at a right angle to the main spreader pad surface engaging portion 25, the side pads thus forming with the spreader pad a retaining structure of rectangular shape which, when the flowable material is discharged therein, will confine the material to the area of the surface over which the spreader is moved, so that the need for repeated passes is at least substantially reduced. The pivotal mounting of the side pads enables them to rotate so that the portions 26 can remain in adequate contact with the material receiving surface over their entire length, despite changes in inclination of the rod to the surface as the apparatus is moved back and forth, and despite use by operators of different heights.

To maintain a suitable pressure on the surface being coated, handle 28 is provided, part way up the rod 10, which may be grasped by the operator with one hand while the other hand holds rod 10 and operates the lever 50.

A valve means comprises a valve closing compression spring 48 interposed between the cross bar 40 and the rod 10 which urges the valve member 42 to the valve closed position, while means for opening the valve when required comprise a hand lever 50 pivoted at 52 to the rod 10 adjacent its upper end and a movable connection comprising a flexible cable 54 connected at its ends to the lever 50 and the valve member 42 and passing over a pulley 56 attached to the handle. Movement of the lever in the direction of the arrow 58 in FIG. 1 against the urge of the spring 48 causes movement of the valve blade member to the open position, while its release results in pivoting movement in the other direction and movement of the valve blade member to the closed position.

Figure 4:
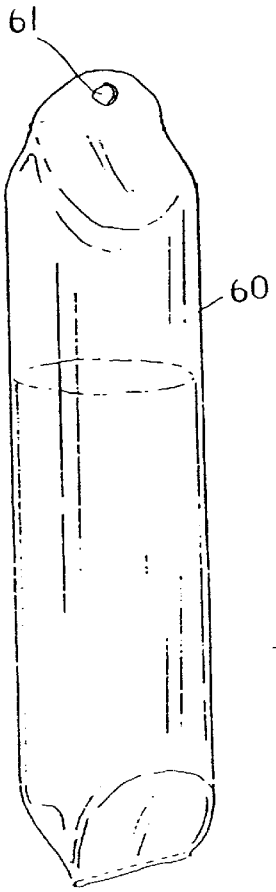
FIG. 4 is a perspective view of a preferred form of container for the flowable material, intended for use with the apparatus of FIGS. 1 and 3, and comprising a sealed bag of transparent flexible plastic material.

As illustrated by FIGS. 1 and 4 the reservoir chamber lining and flowable material container 60 comprises a sealed flexible bag, preferably of plastics material, containing flowable material, as is shown specifically in FIG. 4. Such an arrangement has the particular advantage that the bags can be of convenient size (e.g. 4 liters or 1 gallon) for ready handling, and for relatively small jobs permits the amount of material required to be allocated more exactly with minimization of wastage. The bag is made sufficiently long that upon insertion in the reservoir chamber while sealed a substantial portion of its lower end can protrude below the lower end of the reservoir chamber while the body of flowable material is within the reservoir chamber behind the valve blade 42. Upon installation the lower end of the bag is severed to open it and permit discharge of flowable material under control of the valve means. The upper end of the bag is preferably provided with an eyelet 61 which may be hooked onto spring 62 which is attached to rod 10 as shown in FIG. 1 This improves the flow of adhesive down the bag and provides a convenient way to remove the bag on completion of the operation or when a new bag must be installed.

The plastics material of bag 60 can be transparent, if it is desired to inspect the contents, although suitable transparent materials are generally more expensive than equivalent translucent or opaque materials.

While the clamp 21 has been shown held in place by bolts 23 it will be understood that clamp 21 could be hinged on retainer 13 and rotated by toggles or latches to hold the pad firmly against the retainer 13.

I claim:

1. Manually operable spreading apparatus for the uniform spreading on a surface of a flowable material comprising:

a rod for grasping by an operator of the apparatus;

a removable spreader pad mounted in a spreader pad retainer at on end of said rod extending transversely therefrom at a right angle thereto and having a transversely extending surface engaging portion;

a pair of side pads in side pad retainers pivotally mounted at respective ends of the spreader pad, each having a surface engaging portion extending at a respective right angle to the spreader pad surface engaging portion, the side pads forming with the spreader pad a rectangular retaining structure into which flowable material to be spread is discharged and which confines the flowable material to the area of the surface over which the spreader pad is moved by the operator; and spring means operative between each side pad retainer and the spreader pad retainer and urging the respective side pads to rotate in a direction to maintain contact of their entire surface engaging portions with the surface as the inclination of the rod to the surface is changed;

a reservoir chamber for flowable material on said rod intermediate its ends, the reservoir chamber having an upper and a lower end; and valve means at the lower end of the reservoir chamber operable by the operator to permit discharge of flowable material from the reservoir on to the surface for engagement and spreading thereon by the spreader pad.

2. Spreading apparatus as claimed in claim 1, wherein the spreader pad and the side pads are a unitary molding of closed cell foam.

3. Spreading apparatus for the uniform spreading on a surface of a flowable material comprising:

a rod for grasping by an operator of the apparatus;

a removable foam spreader pad of rectangular cross section mounted in a spreader pad retainer at one end of the rod extending transversely therefrom at a right angle thereto and having a transversely extending surface engaging portion;

a pair of side foam pads integrally formed at respective ends of the spreader pad mounted in side pad retainers each pad having having a surface engaging portion extending at a respective right angle to the spreader pad surface engaging portion, the side pads forming with the spreader pad a rectangular retaining structure into which flowable material to be spread is discharged and which confines the flowable material to the area of the surface over which the spreader pad is moved by the operator; and spring means operative between each side pad retainer and the spreader pad retainer urging the respective side pads to rotate in the direction required to maintain contact of their entire surface engaging portion with the surface as the inclination of the rod to the surface is changed.

* * * * *